United States Patent [19]

McCarthy

[11] Patent Number: 5,004,111

[45] Date of Patent: Apr. 2, 1991

[54] INTERNALLY DELAMINATING TABBED INNERSEAL FOR A CONTAINER AND METHOD OF APPLYING

[75] Inventor: Theresa A. McCarthy, West St. Paul, Minn.

[73] Assignee: Minnesota Mining & Manufacturing Company, St. Paul, Minn.

[21] Appl. No.: 314,392

[22] Filed: Feb. 27, 1989

[51] Int. Cl.[5] ..... B65D 51/18

[52] U.S. Cl. ..... 215/232; 215/250; 215/257; 220/359; 229/3.5 MF; 229/125.35

[58] Field of Search ..... 215/232, 234, 250, 257; 220/265, 270, 285, 359, 258; 229/3.5 MF, 125.33, 125.34, 125.35

[56] References Cited

U.S. PATENT DOCUMENTS

| | | |
|---|---|---|
| 713,824 | 11/1902 | White, Jr. . |
| 745,195 | 11/1903 | Kimsey . |
| 756,601 | 4/1904 | Doremus . |
| 830,735 | 9/1906 | Olsson . |
| 895,719 | 8/1908 | Bradley . |
| 902,843 | 11/1908 | Sheppard . |
| 1,073,071 | 9/1913 | Hall . |
| 2,050,248 | 8/1936 | Eisen . |
| 2,077,992 | 4/1937 | Eisen . |
| 2,131,775 | 10/1938 | Waring . |
| 2,188,946 | 2/1940 | Gutmann . |
| 2,620,939 | 12/1952 | Weisgerber . |
| 2,646,183 | 7/1953 | Pellett . |
| 2,937,481 | 5/1960 | Palmer . |
| 3,032,225 | 5/1962 | Harding . |
| 3,202,308 | 8/1965 | Botkin . |
| 3,317,068 | 5/1967 | Betner . |
| 3,330,720 | 7/1967 | Stevens et al. . |
| 3,389,827 | 6/1968 | Abere et al. . |
| 3,489,307 | 1/1970 | Wenger . |
| 3,501,042 | 3/1970 | Risch et al. . |
| 3,549,440 | 12/1970 | Adcock et al. . |
| 3,565,247 | 2/1971 | Brochman . |
| 3,632,004 | 1/1972 | Grimes et al. . |
| 3,637,101 | 1/1972 | Risch et al. . |

(List continued on next page.)

FOREIGN PATENT DOCUMENTS

| | | |
|---|---|---|
| 040797 | 5/1981 | European Pat. Off. . |
| 045262 | 7/1981 | European Pat. Off. . |
| 109592 | 4/1983 | European Pat. Off. . |
| 109593 | 4/1983 | European Pat. Off. . |
| 111900 | 12/1983 | European Pat. Off. . |

(List continued on next page.)

OTHER PUBLICATIONS

"Increase Packaging Efficiency and Package Performance", DuPont Co., Polymer.

"Cap-Seal ® Closure Liners", 2-pg. brochure from 3M Packaging Systems Division.

"There's a Unipac Induction Seal Just Right for Every Application", 1-pg. brochure from Insulec, Ltd.

Mylar ® For Packaging-Summary of Properties, 2-pg. brochure from DuPont.

*Primary Examiner*—Stephen Marcus

*Attorney, Agent, or Firm*—Merchant, Gould, Smith, Edell, Welter & Schmidt

[57] ABSTRACT

An improved innerseal for sealing containers includes a body portion having an upper surface and structure connected to the upper surface for grasping by a user, whereby the body portion may be removed from a container quickly and efficiently. The body portion includes structure for preventing passage of fluid therethrough, and structure adapted for bonding the body portion against the upper rim of the container with a first bonding force. The bonding structure has a first bonding portion for sealing against the container rim and a second bonding portion which is adhered to the first bonding portion with a second bonding force which is less than the first bonding force. Consequently, a first part of the first bonding portion will delaminate from the second bonding portion over the container rim and remain adhered to the rim, while a second part of the first bonding portion will remain adhered to the second bonding portion, thereby exposing the opening in the container when the grasping structure is pulled. A method for manufacturing containers so sealed is also disclosed.

28 Claims, 8 Drawing Sheets

U.S. PATENT DOCUMENTS

| | | | |
|---|---|---|---|
| 3,900,125 | 8/1975 | Wyler et al. . | |
| 3,923,198 | 12/1975 | Brochman . | |
| 3,963,845 | 6/1976 | Dukess . | |
| 3,964,415 | 6/1976 | Viker et al. . | |
| 3,990,603 | 11/1976 | Brochman . | |
| 4,044,941 | 8/1977 | Knudsen . | |
| 4,089,434 | 5/1978 | Tagalakis et al. . | |
| 4,108,330 | 8/1978 | Patterson . | |
| 4,121,728 | 10/1978 | Tagalakis et al. . | |
| 4,135,637 | 1/1979 | Hannula . | |
| 4,155,439 | 5/1979 | Fletcher et al. . | |
| 4,163,506 | 8/1979 | Patterson . | |
| 4,189,060 | 2/1980 | Trotman, III . | |
| 4,209,126 | 6/1980 | Elias | 215/250 X |
| 4,215,791 | 8/1980 | Brochman . | |
| 4,256,234 | 3/1981 | Mori et al. . | |
| 4,256,528 | 3/1981 | Patterson . | |
| 4,315,047 | 2/1982 | Seabold et al. . | |
| 4,324,601 | 4/1982 | Dembicki et al. . | |
| 4,328,905 | 5/1982 | Hardt | 220/359 X |
| 4,330,353 | 5/1982 | Kunimoto et al. . | |
| 4,372,460 | 2/1983 | Brochman et al. . | |
| 4,373,978 | 2/1983 | Patterson . | |
| 4,378,074 | 3/1983 | Brochman . | |
| 4,381,848 | 3/1983 | Kahn | 229/3.5 MF |
| 4,390,552 | 6/1983 | Niwa . | |
| 4,405,056 | 9/1983 | Patterson . | |
| 4,418,834 | 12/1983 | Helms et al. | 215/232 X |
| 4,423,819 | 1/1984 | Cummings . | |
| 4,424,911 | 1/1984 | Resnick . | |
| 4,436,213 | 3/1984 | Paul, Jr. et al. . | |
| 4,442,129 | 4/1984 | Niwa et al. . | |
| 4,445,620 | 5/1984 | Brochman et al. . | |
| 4,448,326 | 5/1984 | Brochman . | |
| 4,454,956 | 6/1984 | Patterson . | |
| 4,462,502 | 7/1984 | Luenser et al. . | |
| 4,463,116 | 7/1984 | Koyama et al. . | |
| 4,469,754 | 9/1984 | Hoh et al. . | |
| 4,500,011 | 2/1985 | Brochman . | |
| 4,501,371 | 2/1985 | Smalley . | |
| 4,514,248 | 4/1985 | Cummings . | |
| 4,526,562 | 7/1985 | Knudsen et al. . | |
| 4,527,703 | 7/1985 | Cummings . | |
| 4,537,327 | 8/1985 | Lu . | |
| 4,557,505 | 12/1985 | Schaefer et al. . | |
| 4,564,121 | 1/1986 | Brochman . | |
| 4,565,738 | 1/1986 | Purdy . | |
| 4,576,297 | 3/1986 | Larson . | |
| 4,577,777 | 3/1986 | Brochman . | |
| 4,579,240 | 4/1986 | Ou-Yang . | |
| 4,588,099 | 5/1986 | Diez . | |
| 4,588,465 | 5/1986 | Paciorek | 215/232 X |
| 4,595,114 | 6/1986 | Lu . | |
| 4,595,346 | 6/1986 | Eckstein et al. . | |
| 4,596,338 | 6/1986 | Yousif . | |
| 4,625,875 | 12/1986 | Carr et al. . | |
| 4,650,082 | 3/1987 | Paciorek . | |
| 4,666,052 | 5/1987 | Ou-Yang . | |
| 4,673,601 | 6/1987 | Lamping et al. . | |
| 4,684,554 | 8/1987 | Ou-Yang . | |
| 4,693,390 | 9/1987 | Hekal | 220/270 X |
| 4,722,447 | 2/1988 | Crisci . | |
| 4,733,786 | 3/1988 | Emslander . | |
| 4,735,335 | 4/1988 | Torterotot . | |
| 4,754,890 | 7/1988 | Ullman et al. . | |
| 4,757,914 | 7/1988 | Roth et al. | 220/359 |
| 4,767,016 | 8/1988 | Cook, Jr. et al. | 215/232 X |
| 4,778,698 | 10/1988 | Ou-Yang . | |

FOREIGN PATENT DOCUMENTS

| | | |
|---|---|---|
| 128434 | 5/1984 | European Pat. Off. . |
| 135431 | 8/1984 | European Pat. Off. . |
| 1246995 | 4/1964 | Fed. Rep. of Germany . |
| 1281677 | 2/1965 | Fed. Rep. of Germany . |
| 2622012 | 5/1976 | Fed. Rep. of Germany . |
| 3212990 | 11/1982 | Fed. Rep. of Germany . |
| 3311170 | 3/1983 | Fed. Rep. of Germany . |
| 2327161 | 10/1975 | France . |
| 209616 | 7/1940 | Switzerland . |
| 565079 | 8/1975 | Switzerland . |
| 659633 | 12/1978 | Switzerland . |
| 283050 | 1/1928 | United Kingdom . |
| 1495386 | 12/1973 | United Kingdom . |
| 1511250 | 11/1974 | United Kingdom . |
| 1576373 | 3/1977 | United Kingdom . |
| 1536428 | 12/1978 | United Kingdom . |
| 2052726 | 7/1979 | United Kingdom . |
| 2072131 | 3/1981 | United Kingdom . |
| 2177974 | 7/1986 | United Kingdom . |

INTERNALLY DELAMINATING TABBED INNERSEAL FOR A CONTAINER AND METHOD OF APPLYING

BACKGROUND OF THE INVENTION

1. Field of the Invention

This invention relates to container innerseals, which are used in conjunction with a conventional threaded on cap to provide an air tight, hermetically closed seal for containers. More specifically, the invention relates to an improved innerseal for a container which is easier to remove, and promotes ease of removal in conjunction with improved sealability for containers on which it is applied relative to those innerseals which were heretofore known.

2. Description of the Prior Art

In view of the need in contemporary society for air tight, hermetically closed seals on containers for food, medicine and the like, closures have been developed which incorporate an innerseal bonded with an adhesive to an upper container rim. To effect such a seal, a filled container after being capped is passed through an electromagnetic field generated by induction heating equipment, which heats a foil layer within the innerseal, thereby bringing about the melting of a heat sealable polymeric film coating. One system of this type which has met with significant commercial success bears the trademark "Safe-Gard", and is manufactured by the Minnesota Mining and Manufacturing Company of St. Paul, Minn. This system provides a hermetic seal that is suitable for use with ingestible commodities. The seal is particularly effective for products which should be preferably kept free from contamination, oxidation and/or moisture. However, it is difficult to effectively control the adhesive force by which such innerseals are bonded to the containers, due to the dependency of the sealing force on the amount of inductive power that is applied. Accordingly, it has previously been necessary to maintain strict control over the amount of power that is applied during sealing of such containers, and a wide range of seal tightness may result even if the power range is effectively controlled. Moreover, the amount of sealing force which could be used was limited by the fact that a proportional amount of force was needed to remove the innerseal from the container by the end user. As a result such seals had to be penetrated or scraped off with a sharp implement such as a knife. This problem was compounded by the inconsistency of sealing forces from container to container and the limitations on sealing force as discussed above.

Although innerseals which have integral tab portions for gripping purposes have been developed, as is disclosed in U.S. Pat. No. 4,754,890 to Ullman et al., the basic problem of grippability in conjunction with a limited and unpredictable range of sealing forces has not been effectively solved to date. It is within this context that the present invention assumes significance.

It is clear that there has existed a long and unfilled need in the prior art for container innerseals which are easily removable by an end user without scraping or puncturing, and that have a consistent removal force which allows a strong seal to be provided between the innerseal and container regardless of the sealing force, and that obviates the need for strict control during the sealing process.

SUMMARY OF THE INVENTION

According to the invention, a sealed container of the type which is provided with safety innerseal includes a body portion having an upper surface and adapted for fitting over the upper rim of the container, the body portion including membrane structure for preventing passage of fluid through the body portion; structure adapted for bonding the body portion against the upper rim of the container; the bonding structure having a first bonding portion for bonding against the container rim with a first bonding force and a second bonding portion which is adhered to the first bonding portion with a second bonding force which is less than the first bonding force, said first bonding portion having a rupture strength that is less than either of said second bonding force and said first bonding force; and structure connected to the upper surface of the body portion for grasping by a user, whereby the body portion may be removed from a container by pulling the upper grasping structure, whereby a first part of the first bonding portion will delaminate from the second bonding portion over the container rim and remain adhered to the rim, while a second part of the first bonding portion will remain adhered to the second bonding portion, thereby exposing the opening.

According to a second aspect of the invention, a method for forming a sealed container of the type which includes a safety innerseal includes the steps of providing a container body having an upper rim; placing an innerseal constructed as detailed above over the upper rim; and passing the container and innerseal through a heating station, whereby the innerseal is sealed onto the container body to form a tight, effective closure.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
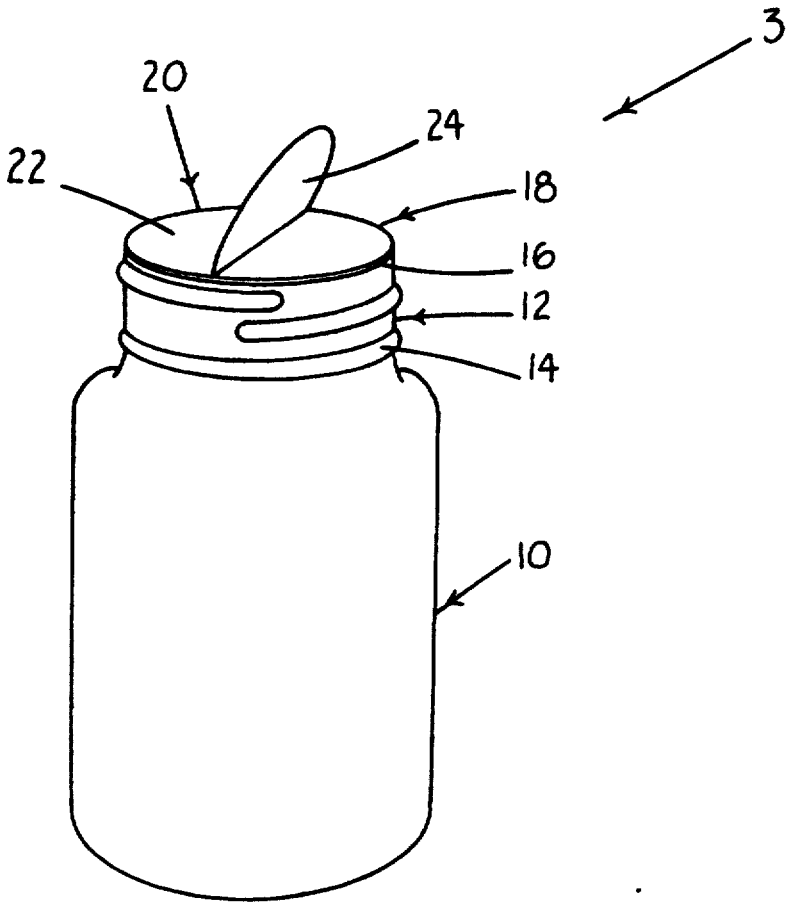
FIG. 1 is a perspective view of a sealed container constructed according to a first preferred embodiment of the invention.

Referring now to the drawings, wherein like reference numerals designate corresponding structure throughout the views, and in particular referring to FIG. 1, a container 10 having a neck portion 12 and a rim 16 includes a raised helical thread 14 formed upon neck portion 12 over which an appropriate sealing cap with mating threads may be applied (not shown), as is known throughout the art.

An arrangement 18 is provided for sealing an orifice defined in container 10 by rim portion 16. Sealing arrangement 18 includes a removable innerseal 20 having a circular body portion 22 which includes an upper surface facing away from container 10. Innerseal 20 further includes a tab portion 24 attached to the upper surface of circular body portion 22, as is shown in FIG. 1. Body portion 22 is sized so as to extend over the full extent of the orifice and over rim 16. In the illustrated embodiment, tab portion 24 is formed so as to connect to body portion 22 along a line which extends substantially across the width of body portion 22.

Figure 2:
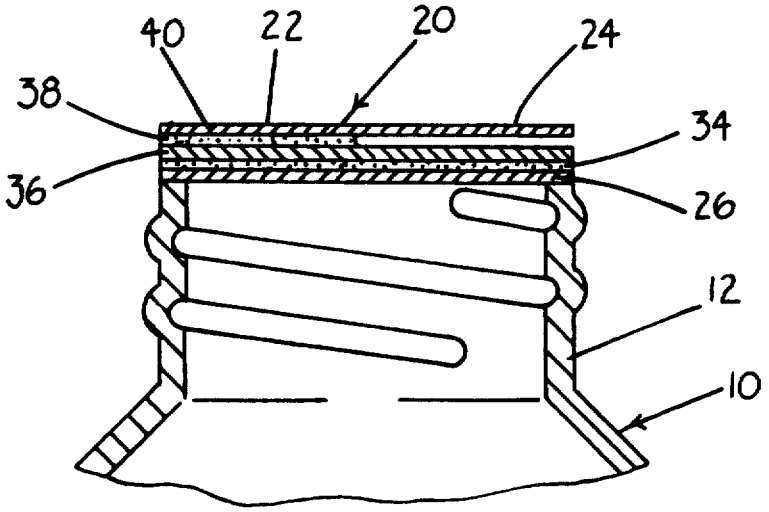
FIG. 2 is a cross-sectional elevational view of the container assembly illustrated in FIG. 1.
Figure 3:
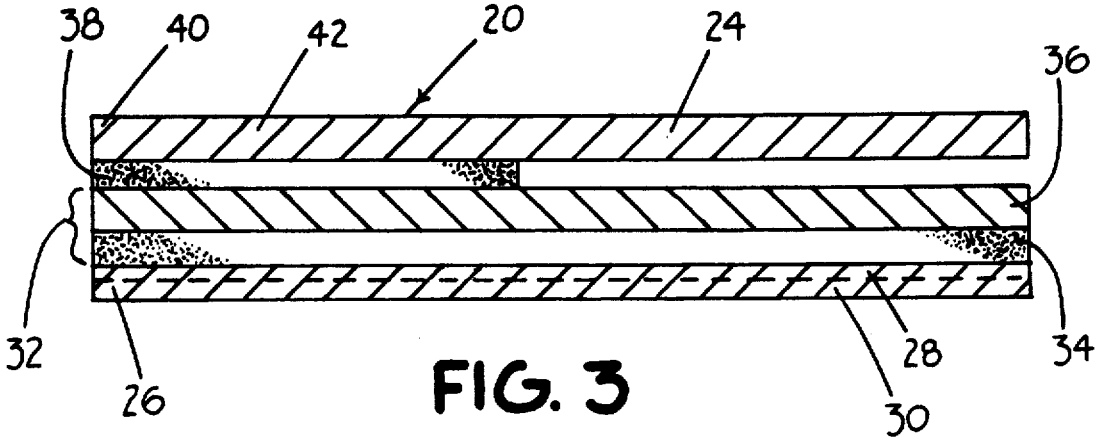
FIG. 3 is a representative cross-sectional view of an innerseal constructed according to a first preferred embodiment of the invention.

Referring now to FIGS. 2 and 3, the various components of a layered material which together form innerseal 20 include a bonding lower sealing layer 26, a fluid impermeable membrane 32, and a force transmitting layer 40. In the embodiment which is illustrated in FIGS. 2 and 3, the bonding sealing layer 26 is formed of a heat sealable film or laminate having an upper bonding portion which is embodied as an upper strata 28 and a lower bonding portion which is embodied as a lower bonding portion strata 30, which is formulated to have a lower melting point than upper strata 28.

Lower strata 30 is bonded to rim 16 with a first bonding force, and to upper strata 28 with a second bonding force which is less than the first bonding force. Both the first bonding force and second bonding force are greater than the rupture strength of lower strata 30. A third bonding force between the sealing layer 26 and membrane 32 is greater than the second bonding force. Preferably, sealing layer 26 is formed of a multilayer heat sealable polymeric film such as 50 OL-2 Mylar film, which is a polyester multilayer film and is available from the DuPont Corporation of Wilmington, Del. The 50 OL-2 film consists of an upper strata 28 having a thickness of approximately 0.4 mils (0.01 mm) and a lower strata 30 having a thickness of approximately 0.1 mils (0.002 mm) which is bonded to the upper layer. Both the upper and lower layers are composed of polyester. Alternatively, sealing layer 26 may be formed of polyethylene, polypropylene, ethylene vinyl acetate copolymer (EVA) or a similar heat sealable material having relatively low tensile and shear strengths.

In the embodiment depicted in FIGS. 2 and 3, fluid impermeable membrane 32 preferably includes a foil layer 36 and an adhesive layer 34 for bonding foil layer 36 to sealing layer 26. Adhesive layer 34 may for example be formed of Adcote 503A adhesive, which is manufactured by Morton Norwich Products, Inc. of Chicago, Ill. and is preferably spread to a coating weight of 1-2 grains per each 24 square inches (83.7-167.4 mg./200 $cm^2$). Alternatively, adhesive layer 34 may be formed of other adhesives, such as Lamal T-8, which is available from Morton Thiokol, Inc. of Chicago, Ill. Foil layer 36 is preferably formed of aluminum foil and has a preferred thickness of between 1 and 2 mils (0.0254-0.051 mm).

As may be seen in FIG. 3, force transmitting layer 40 is bonded to fluid impermeable membrane 32 by an adhesive layer 38. Adhesive layer 38 may be formed of Dow 238 styrene-butadiene rubber laminating adhesive or an equivalent pressure sensitive adhesive substance, and is preferably spread to a coating weight of approximately 1-2 grains per each 24 square inches (83.7-167.4 mg/200 $cm^2$). Force transmitting layer 40 includes a secured portion 42 which is bonded to fluid impermeable membrane 32 by adhesive layer 38, and an unsecured tab portion 24 which may be bent upwardly relative to secured portion 42 and grasped by a user to remove innerseal 20 from a container 10. Force transmitting layer 40 is preferably formed of a sheet material having relatively high tensile and shear strengths, such as 100 lb./3300 $ft.^2$ Latex Coating Base paper Code X-63, which is available from Wausau Papers of Brokaw, Wis., and has a thickness of approximately 0.007 inches (0.18 mm) Alternatively, force transmitting layer 40 may be constructed of foamed polymer, such as 0.012 inches (0.30 mm) thick foamed polypropylene film, which is available from Synthetic Fibers, Inc. of Newtown, Pa. Layer 40 may also be formed from the class of materials known as non-woven fabrics, such as Tyvek ®, which is manufactured by DuPont Corporation, or an equivalent material having high tensile and shear strength.

The following is a non-exclusive example of a sealing member which was constructed according to the embodiment of the invention illustrated in FIGS. 2 and 3 and has proven satisfactory:

EXAMPLE 1

In this construction, an innerseal 20 was formed as shown in FIG. 3 with a force transmitting layer 40 fabricated of 100 lb. paper of the type previously described as obtainable from Wausau Papers, of Brokaw, Wis. Fluid impermeable membrane 32 included a layer 36 of 0.001 inches (0.02 mm) thick aluminum foil, which was obtained from Aluminum Company of America of Davenport, Iowa. Adhesive layer 38 was formed of Dow 238 adhesive was obtained from Dow Chemical Co. Adhesive layer 34 was formed of Adcote 503A adhesive at a coating weight of between 0.92-1.4 grains/24 $in^2$ (77.4-117.2 mg/200 $cm^2$). Sealing layer 26 was formed of a 0.05 mil thick (0.13 mm) 50 OL-2 Mylar brand film, which is available from DuPont Corporation of Wilmington, Del. The Mylar 50 OL-2 film is constructed to internally delaminate into upper and lower strata 28, 30 upon the application of peel and shear forces at a predetermined level. This example is particularly adapted for bonding to a container constructed of polyester.

Figure 4:
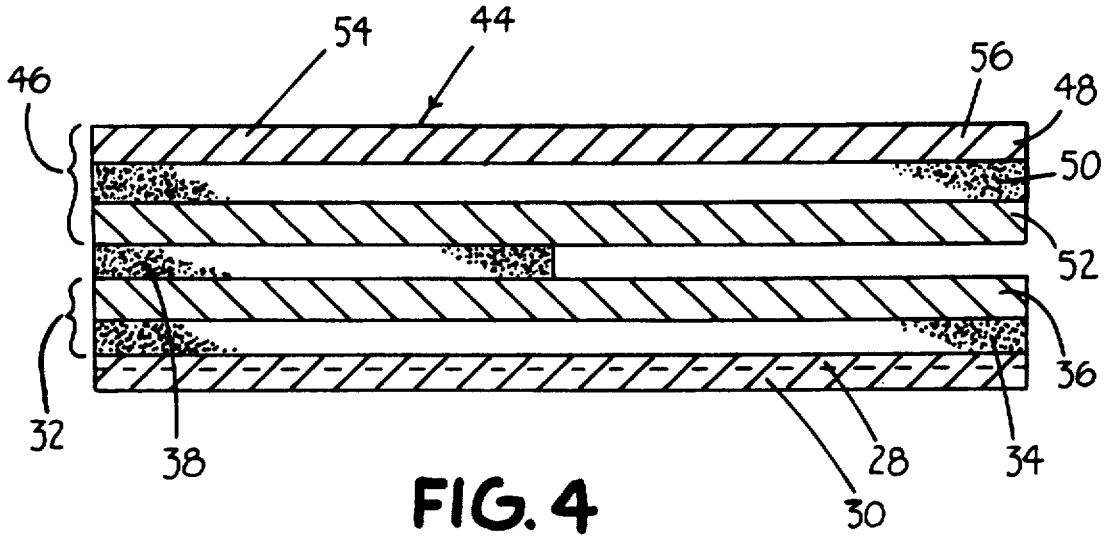
FIG. 4 is a representative cross-sectional view of an innerseal constructed according to a second preferred embodiment of the invention.

Referring now to FIG. 4, an innerseal 44 constructed according to a second embodiment of the invention includes a sealing layer 26, a fluid impermeable membrane 32 and an adhesive 38 which are constructed as described above with reference to the previous embodiment. The relationship between the first through third bonding forces and the rupture strength of the lower bonding layer are the same as described above in reference to FIG. 3. However, in lieu of the single force transmitting layer, innerseal 44 is provided with a force transmitting membrane 46 having a secured portion 54 and a tab portion 56 which is adapted to be bent upwardly and grasped by a user to remove the innerseal 44 from a container 10. Force transmitting membrane 46 includes an upper layer 48, a lower layer 52 and an adhesive layer 50 for laminating upper layer 48 to lower layer 52. Upper layer 48 exists primarily for reinforcement purposes and is preferably formed of paper or an equivalent substance upon which a pattern or color may be printed. Lower film 52 is preferably formed of a sheet material having relatively high tensile and shear strengths, such as a polymeric film, a polymeric foam, a non-woven fabric or a high strength paper. Most preferably, layer 52 is formed of a polymeric film such as a 0.0015 inch (0.04 mm) thick sheet of uniaxially oriented unplasticized polyvinylchloride (PVC) film, which is obtainable from HPT Plastics, Inc. of Cincinnati, Ohio. Upper layer 48 is most preferably formed from 0.0048 inch (0.12 mm) thick 60 lb. white paper, which is available from Thilmany Pulp and Paper Company of Kauakuna, Wis., or any other sheet material having sufficient strength. Adhesive layer 38 may be formed of any adhesive capable of bonding the selected materials in layers 48, 52 together, and is most preferably formed of Adcote 503A adhesive.

The following is a non-exclusive example of a sealing member constructed according to the embodiment illustrated in FIG. 4, which has proven to be satisfactory:

EXAMPLE 2

An innerseal 44 was constructed as shown in FIG. 4 with a force transmitting membrane 46 including an upper layer 48 which was formed of 0.0048 inch (0.12 mm) thick 60 lb. white paper (#84600MG-PC 11625040 paper) from Thilmany Pulp and Paper Company of Kauakuna, Wis. Layer 52 was formed of a 0.0015 inch (0.04 mm) thick layer of uniaxially oriented unplasticized polyvinylchloride film, which was obtained from HPT Plastics, Inc. of Cincinnati, Ohio. Adhesive layer 50 was formed of Adcote 503A adhesive, at a coating weight of approximately 1 grain/24 in$^2$ (83.7 mg/200 cm$^2$). A first portion of film 52 was laminated to a layer 36 of 0.001 inch (0.02 mm) thick aluminum foil, which was obtained from the Aluminum Company of America of Davenport, Iowa. A sealing layer 26 which was composed of Mylar 50 OL-2 film was laminated to foil layer 36 by an adhesive layer 34, which was formed of Adcote 503A adhesive. This construction is particularly adapted for bonding to a container constructed of polyester or polyvinyl chloride.

Figure 5:
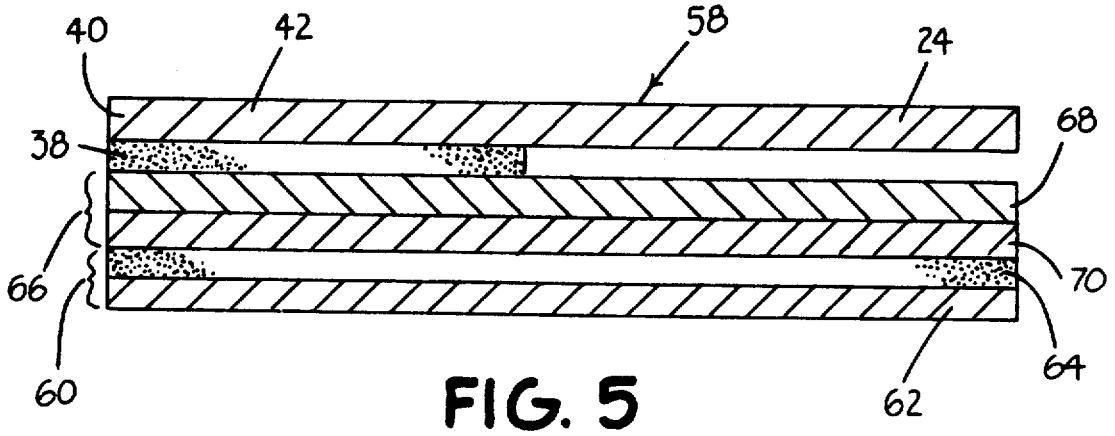
FIG. 5 is a representative cross-sectional view of an innerseal constructed according to a third preferred embodiment of the invention.

Referring now to FIG. 5, an innerseal constructed according to a third embodiment of the invention includes a force transmission layer 40 having a secured portion 42 and a tab portion 24, with secured portion 42 adhered to a remainder of innerseal 58 by an adhesive layer 38, in a manner which has been described above with reference to previous embodiments. However, in contrast to previous embodiments, innerseal 58 includes a sealing laminate 60 for sealing onto a rim 16 of container 10, and a fluid impermeable membrane 66. Fluid impermeable membrane 66 preferably includes an upper foil layer 68 and a layer 70 of primer. Sealing laminate 60 preferably includes a second bonding portion of an upper layer 64 of pressure sensitive adhesive and a first bonding portion of a lower layer 62 of heat sealable film. Pressure sensitive adhesive layer 64 is preferably formed of a natural rubber pressure sensitive adhesive. Sealing film 62 is preferably constructed of an appropriate heat sealable material, such as polyethylene film. The first bonding portion 62 is bonded to the container with a first bonding force that is greater than a second bonding force which exists between the two bonding portions. A third bonding force which is greater than the second bonding force exists between second bonding portion 64 and membrane 66. The rupture strength of first bonding portion 62 is less than any of the bonding forces. Foil layer 68 is preferably formed of aluminum foil and has a preferred thickness of between 1 and 2 mils (0.0254–0.051 mm). Primer layer 70 is preferably formed of a chlorinated polyolefin solvent based primer such as CP 343-1, which is available from Eastman Chemical Products, Inc. of Kingsport, Tenn.

The following is a non-exclusive example of an innerseal which was constructed according to the embodiment of the invention illustrated in FIG. 5 and which has proven to be acceptable:

EXAMPLE 3

An innerseal 58 was constructed as shown in FIG. 5 with a force transmission layer 40 composed of 100 lb. paper, which was obtained from Wausau Papers of Brokaw, Wis. Adhesive layer 38 was formed of Spenbond 650 adhesive with 651 curing agent, which was obtained from NL Chemicals, Inc. of Highstown, N.J. Foil layer 68 was formed of 0.001 inch (0.02 mm) thick aluminum foil, which was obtained from the Aluminum Company of America of Davenport, Iowa. Primer layer 70 was formed of Eastman CP 343-1. A layer 64 of natural rubber pressure sensitive adhesive which was spread to a coating weight of 0.4 grains per 24 in$^2$ (33.48 mg/200 cm$^2$) over the primer. Sealing film 62 was composed of a 0.001 inch (0.02 mm) thick No. 610 polyethylene film, which was obtained from Consolidated Thermoplastics Company of Chippewa Falls, Wis. This example was particularly adapted for bonding to a container constructed of polyethylene.

Figure 6:
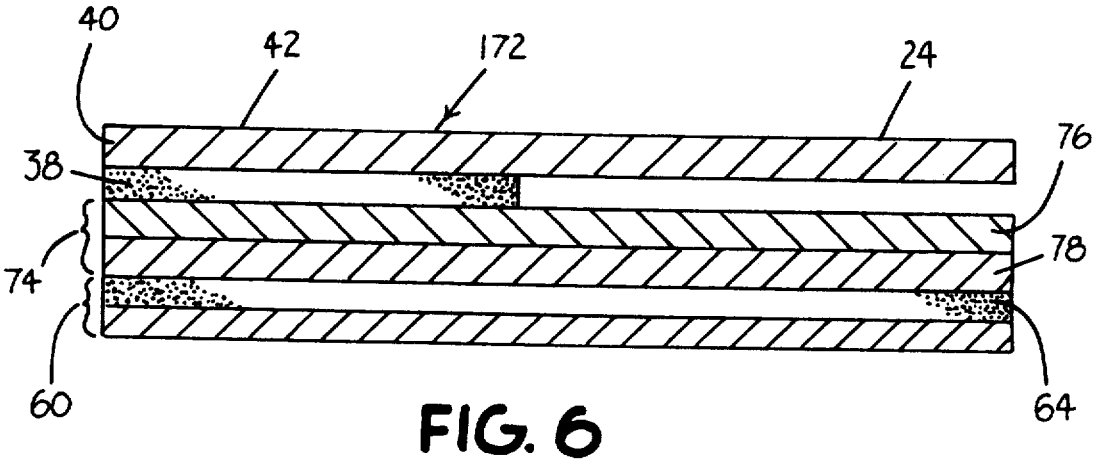
FIG. 6 is a representative cross-sectional view of an innerseal constructed according to a fourth preferred embodiment of the invention.

Referring now to FIG. 6, an innerseal constructed according to a fourth embodiment of the invention includes a force transmission layer 40 having a secured portion 42 and a tab portion 24, with secured portion 42 adhered to a remainder of innerseal 72 by an adhesive layer 38, in a manner which has been described above with reference to previous embodiments. Innerseal 72 further includes a sealing laminate 60 which is constructed as described above with reference to the previous embodiment, and inherently possesses the same bonding force relationships. However, in contrast to previous embodiments, innerseal 72 includes a fluid impermeable membrane 74 which is composed of an upper foil layer 76, and a lower layer 78 of polymeric film. Layers 76, 78 may be pre-purchased as a commercially available laminate, such as 0.0022 inch (0.056 mm) thick aluminum foil/polypropylene laminate, which is available from Aluminum Company of America, Alcoa Center, Pa. The Alcoa laminate includes a layer 78 of 0.0012 inch (0.02 mm) thick F-228C polypropylene film laminated to the foil layer with an F-247 adhesive.

The following are non-exclusive examples of innerseals which were constructed according to the embodiment of the invention illustrated in FIG. 6 and which have proven to be acceptable:

EXAMPLE 4

An innerseal 72 was constructed as shown in FIG. 6 with a fluid impermeable membrane 74 constructed of a 0.002 inch (0.05 mm) thick aluminum foil/polypropylene laminate which was obtained from Aluminum Company of America, Alcoa Center, Pa. Sealing laminate 60 was formed of an adhesive layer 64 formulated of natural rubber pressure sensitive adhesive, at a coating weight of 0.4 grains per square inches (33.48 mg/200 $cm^2$), and sealing film 62 was fabricated of 0.01 inch (0.02 mm) thick No. 610 polyethylene film, which was obtained from Consolidated Thermoplastics Company of Chippewa Falls, Wis. Force transmission layer 40 was fabricated from a 0.007 inch (0.18 mm) thick 100 lb./3300 square ft. latex coating base paper which was obtained from Wausau Papers of Brokaw, Wis. Adhesive layer 38 was formed from Spenbond 650 adhesive with a 651 curing agent. This example is particularly adapted for bonding to a container constructed of polyethylene, and provides additional strength for the aluminum foil layer.

EXAMPLE 5

An innerseal 72 was constructed as described above in reference to Example 1 and as shown in FIG. 6, except that force transmission layer 40 was fabricated of 0.012 inch (0.30 mm) thick foamed polypropylene film, which is available from Synthetic Fibers, Inc. of Newtown, Pa. In this example, adhesive layer 38 was formed of Adcote 503A adhesive spread to a coating weight of 0.92–14 grains per 24 $in^2$ (77.4–117.2 mg/200 $cm^2$). This example is also particularly adapted for bonding to a container constructed of polyethylene.

Figure 7:
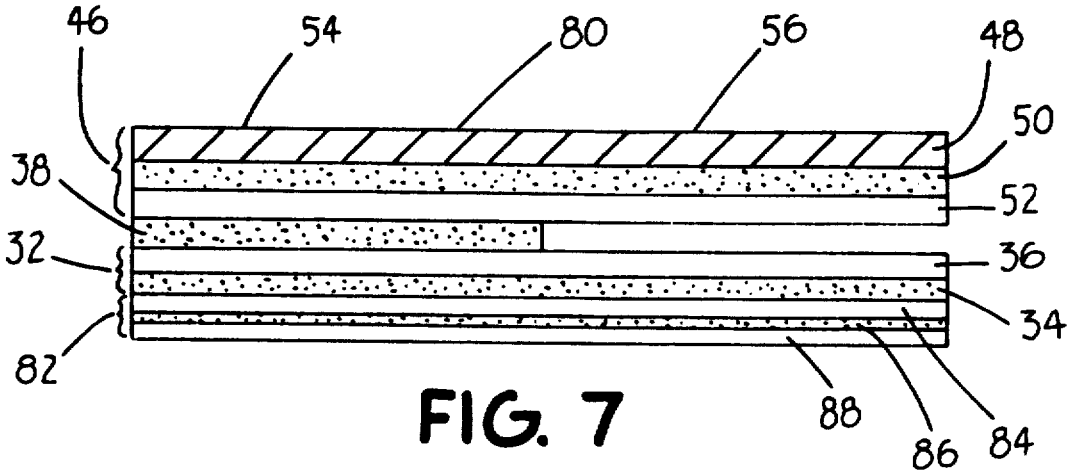
FIG. 7 is a representative cross-sectional view of an innerseal constructed according to a fifth preferred embodiment of the invention.

Referring now to FIG. 7, an innerseal 80 constructed according to a fifth embodiment of the invention includes a force transmitting membrane 46 having a secured portion 54 and a tab portion 56 as well as layers 48, 50 and 52 which are constructed as described above in reference to previous embodiments. Adhesive layer 38 bonds force transmitting membrane 46 to fluid impermeable membrane 32, which includes a foil layer 36, an adhesive layer 34 and a primer layer 84 of polymeric film. However, innerseal 80 incorporates a sealing laminate 82 having a lower layer 88 of heat sealable film and an adhesive layer 86 for bonding primer layer 84 to layer 88. The bonding relationships and rupture strength within laminate 82 are the same as discussed above in the reference to the embodiment of FIG. 3. Preferably, primer layer 84 is formed of a polymeric film such as 0.001 inch (0.02 mm) thick polypropylene film, which is available from Exxon Chemical Company of Mar-Lin, Pa., or an equivalent material. Layer 88 is preferably formed from a heat sealable material such as polyethylene or polyester. Adhesive layer 86 may be formed from any adhesive which is capable of bonding the materials used in layer 84 to those which are used in layer 88, and is preferably composed of Adcote 503A.

The following is a non-exclusive example of a sealing member which has been constructed according to the embodiment of FIG. 7 and has proven satisfactory:

EXAMPLE 6

An innerseal 80 was constructed as shown in FIG. 7 with a force transmitting membrane 46, and adhesive layer 38 and a fluid impermeable membrane 32 constructed identically to the example which was given for the embodiment illustrated in FIG. 4, except primer layer 84 was formed of a layer 84 of 0.001 inch (0.02 mm) thick polypropylene film, which was obtained from Exxon Chemical Company. Heat sealable layer 88 was formed of 0.001 inch (0.02 mm) thick No. 610 polyethylene film, which was obtained from Consolidated Thermal Plastics Company of Chippewa Falls, Wis. Adhesive layer 86 was formed of a natural rubber pressure sensitive adhesive at a coating weight of 0.4 grains per 24 $in^2$ (3348 mg/200 $cm^2$). This example is particularly adapted for bonding to a container 10 which is constructed of polyethylene.

Figure 8:
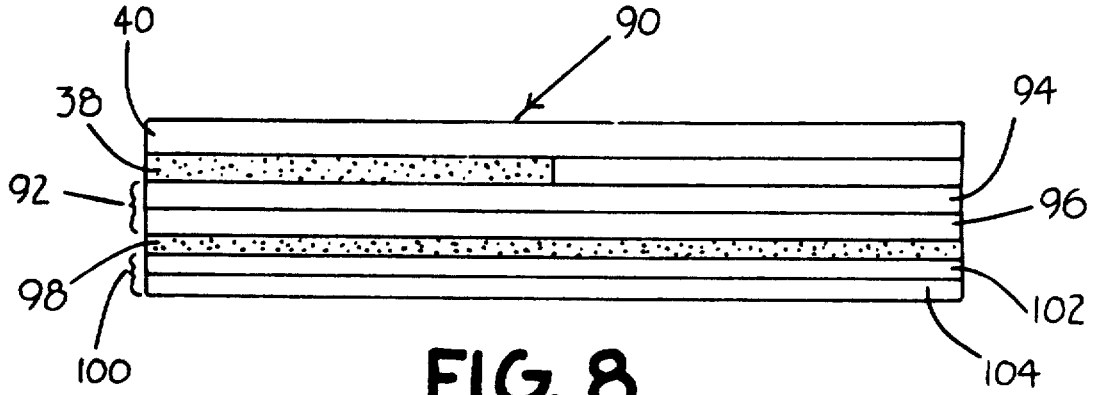
FIG. 8 is a representative cross-sectional view of an innerseal constructed according to a sixth preferred embodiment of the invention.

Referring now to FIG. 8, an innerseal 90 constructed according to a sixth embodiment of the invention includes a force transmitting layer 40, and an adhesive layer 38 which are constructed as described above with reference to previous embodiments, and possess the bonding relationships inherent thereto. Innerseal 90 includes a fluid impermeable membrane 92 which is formed of a foil layer 94 to which adhesive layer 38 is bonded, and a polymeric layer 96 which is bonded to a lower surface of foil layer 94. A sealing laminate 100 is bonded to membrane 92 by an adhesive layer 98, and includes an upper layer 102 and a lower heat sealing layer 104. Foil layer 94 is preferably formed of aluminum, and has a thickness of between 1 and 2 mils (0.0254–0.051 mm). Polymeric film 96 is preferably formed of polypropylene or an equivalent polymer, and may be purchased with foil layer 94 as a laminate from Aluminum Company of America, Alcoa Center, Pa. Sealing laminate 100 is preferably formed from a coextruded film consisting of an upper layer 102 formed of ethylene vinyl acetate and a lower heat sealable layer formed of polypropylene or an equivalent heat sealable substance. Adhesive layer 98 is formed of a natural rubber PSA for bonding the materials in membrane 92 to sealing laminate 100.

The following is a non-exclusive example of an innerseal 90 constructed according to the embodiment of FIG. 8:

EXAMPLE 7

An innerseal 90 was constructed as shown in FIG. 8 with a force transmitting layer 40 of 100 lb. paper partially adhered to membrane 92 with Spenbond 650 adhesive with 651 curing agent, which was obtained from NL Chemicals, Inc. of Highstown, N.J. Fluid impermeable membrane 92 was formed of a 0.0022 inch (0.056 mm) thick aluminum foil/polypropylene laminate which was obtained from Aluminum Company of America, Alcoa Center, Pa. The laminate includes a layer of 0.0012 inch (0.02 mm) thick F-228C polypropylene film laminated to the foil layer with a F-247 adhesive. Sealing laminate 100 was formed of a coextruded film consisting of ethylene vinyl acetate and polypropylene, which is available from the Crown Advanced Film division of the James River Corporation in Orange, Tex. Adhesive layer 98 was formed of a natural rubber pressure sensitive adhesive spread to a coating weight of 0.4 grains per 24 square inches (33.48 mg/200 $cm^2$). This example is particularly adapted for bonding to a container made of polypropylene.

Figure 9:
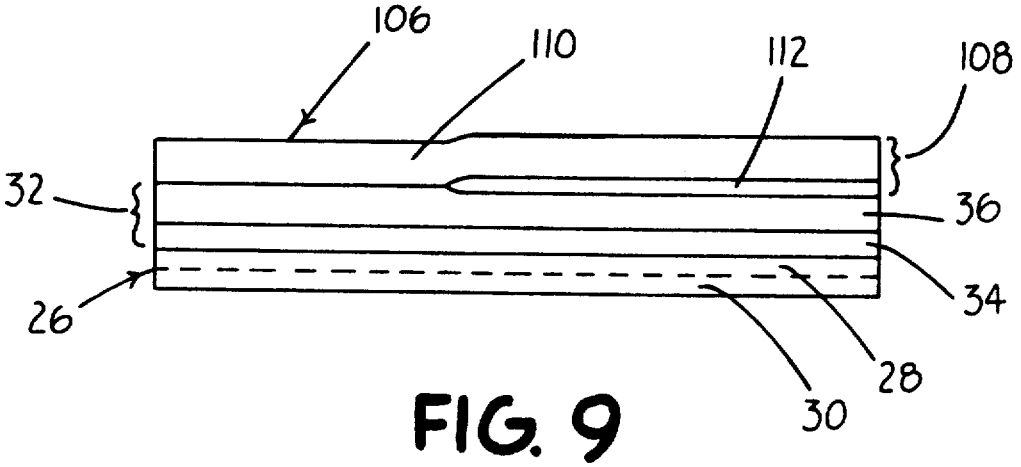
FIG. 9 is a representative cross-sectional view of an innerseal constructed according to a seventh preferred embodiment of the invention.

Referring now to FIG. 9, an innerseal 106 constructed according to a seventh embodiment of the invention includes a force transmitting membrane 108 which is formed of a layer 110 of pressure sensitive adhesive tape, which is laminated to a fluid impermeable membrane 32 at a first portion thereof, as is shown in FIG. 9. Membrane 32, adhesive layer 34 and sealing layer 26 may be constructed as described above with reference to previous embodiments, or as described below in Example 8. A detack layer 112 is adhered to the portion of pressure sensitive adhesive tape 110 which is not laminated to fluid impermeable membrane 32. As a result, a tab is formed which may be bent upwardly and pulled by a user to remove innerseal 106 from a container 10. An example of the type of tape which can be used is 3M 355 TM. The detack layer may be formed of 84600 paper from Thilmany Paper Company.

The requirements for the tape 110 are than it adheres well to foil and that it is strong enough to be pulled without tearing or breaking before the innerseal is removed. Another tape that would work is 3M No. 610 Tape.

The detack layer 112 can be any paper that would not bond to the foil during heat sealing. The layer 112 can be a silicone coated paper although this would add cost. The layer 112 can also be a film that would bond well to the tape.

The following is a non-exclusive example of an innerseal constructed according to the embodiment of FIG. 9.

EXAMPLE 8

An innerseal was made with a 0.001 inch (0.025 mm) thick aluminum foil membrane 32. The top surface of membrane 32 is laminated to a pressure sensitive tape 110 partially masked with detack paper 112 to form the tab. The tape is 3M No. 355 Tape available from Minnesota Mining and Manufacturing Company of St. Paul, Minn. The detack paper 112 used to mask part of the tape is a 0.002 inch (0.051 mm) thick 14 lb white paper, No. 84600, available from Thilmany Pulp and Paper Co. of Kaukauna, Wis. The bottom surface of the membrane was primed with a layer 34 of Eastman CP 343-1 primer, and coated with a layer 28 of natural rubber pressure sensitive adhesive to a coating weight of 0.39 grains per 24 square inches (32.6 mg/200 $cm^2$), and laminated to a 0.001 inch (0.025 mm) thick No. 610 polyethylene film 30 available from Consolidated Thermoplastics Co. of Chippewa Falls, Wis. This innerseal is adapted for polyethylene bottles.

Figure 10:
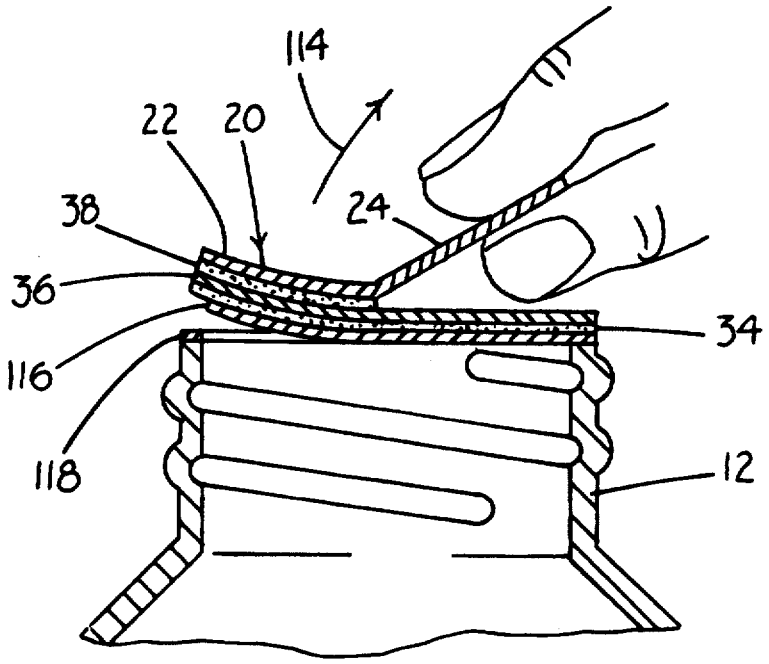
FIG. 10 is a diagrammatical view illustrating removal of an innerseal from a container according to the invention.
Figure 11:
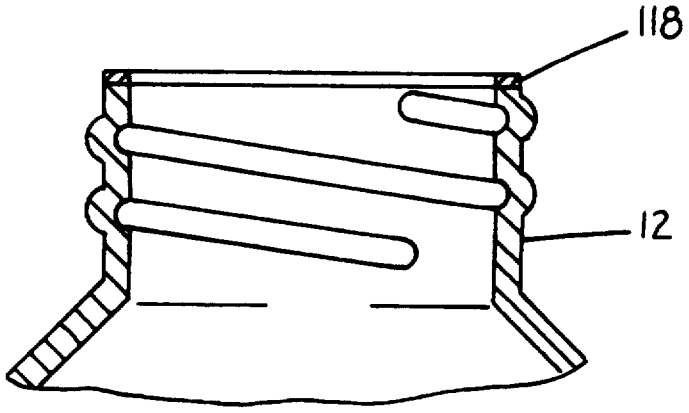
FIG. 11 is a cross-sectional view of a container according to the invention once an innerseal has been removed.

Referring now to FIGS. 10 and 11, the removal of an innerseal according to the invention from a container 10 will now be described. It should be understood that while the opening process is being described with reference to an innerseal 20, the same procedure applies to all embodiments previously discussed.

Innerseal 20 is sealed onto the rim portion 16 of container 10 in a manner which will be described below. To remove innerseal 20 from its position around rim 16 as is shown in FIG. 2, the tab portion 24 is grasped and pulled upwardly. This movement initially results in delamination of materials within innerseal 20 while sealing layer 26 remains adhered to the rim portion 16 of container 10. In the case of the embodiment which is illustrated in FIGS. 2 and 3, in which sealing layer 26 is formed of a multilayered film, delamination has been found to occur substantially along the interface between the two component layers 28, 30 of polyester within the film, with the exception that a certain amount of splitting may occur into the lower layer during delamination. For example, delamination may initially occur on the interface portion, deviate slightly into the lower layer of polyester, then return to the interface layer. The delaminated area which is caused to adhere to rim portion 16 is depicted in FIGS. 10 and 11 as a second portion 118 of the sealing layer. As tab portion 24 is pulled further upwardly, the sealing layer 26 is caused to rupture and then to tear progressively around the inner edge of rim 16, until the body portion 22 is completely removed from container 10. In this way, a first portion 116 of sealing layer 26 remains adhered to body portion 22, as is shown in FIG. 10.

Figure 12:
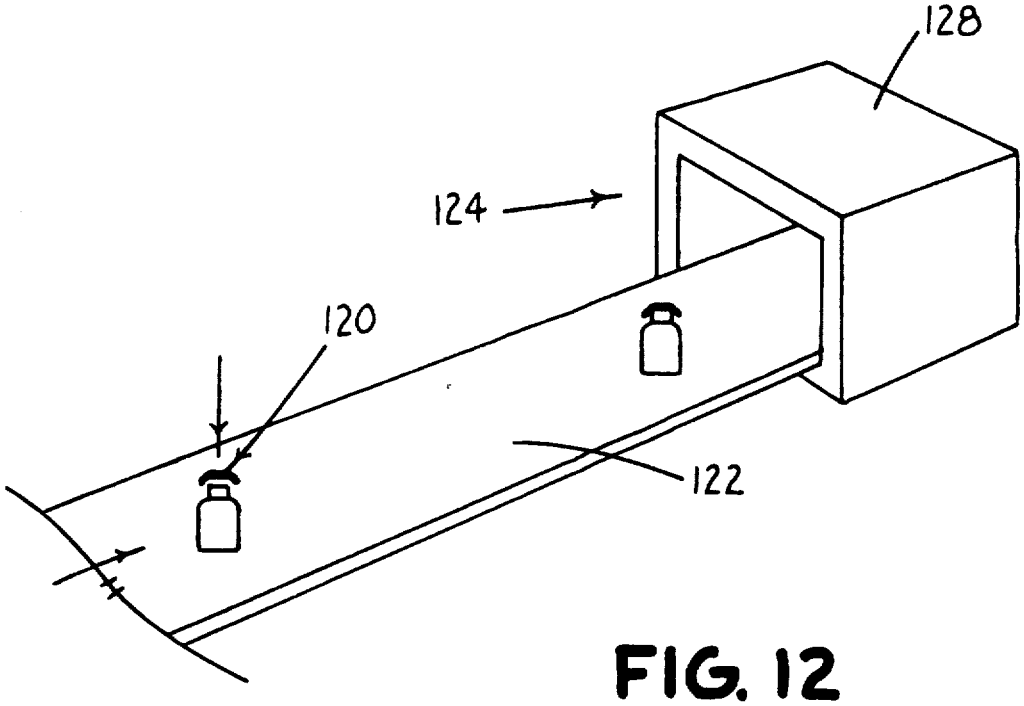
FIG. 12 is a diagrammatical view of an application and heating station according to the invention.

Referring now to FIG. 12, the preferred process for applying an innerseal to a container according to the invention will now be described. As is shown in FIG. 12, an innerseal 20 is first placed over the opening in container 10 so that its peripheral edges extend over rim portion 16. This may be done directly, or by placing the innerseal 20 within a threaded cap member and threading the cap member onto threads 14 of neck portion 12 so that the innerseal 20 is forced against rim 16, in a manner that is known in the art. This process is depicted schematically in FIG. 12 at an application station 120. After application of innerseal 20 to a container 10, the assembly is transported via a conveyor 122 or the like to a heat sealing station 124, which includes an induction heater 128. As the assembly consisting of bottle 10 and innerseal 20 passes through induction heater 128, the layer 36 of metallic foil is heated up, which in turn causes layer 26 to melt and adhere to rim 16, effectively sealing innerseal 20 onto the neck portion of container 10. The amount of heat applied to innerseal 20 must be sufficient to cause layer 26 to melt and adhere to rim 16 with more adhesive force than exists internally within body portion 22, for the reasons discussed above, and to ensure proper sealing of the container 10.

TESTS

The following Tables 1-3 record the results of tests performed on samples of plastic bottles having sealing members constructed according to various embodiments of the present invention bonded over openings in the bottles. The tests measured the pressure retention of the sealing members as well as the force required to remove the sealing member from the bottle.

Table 1 records the results of tests performed on a sealing member which is marketed by Stanpac, Inc. of Smithville, Ontario, Canada under the trademark "Top Tab" and includes a sheet having an upper layer of paper 0.0042 inches (0.11 mm) thick.

Table 2 records the results of a sealing member constructed according to the embodiment shown in FIG. 6 and described as Example 1. Table 3 records the results of another embodiment of the sealing member shown in FIG. 3 and described as Example 1.

In one test for pressure retention shown in Tables 1 and 2, a bottle having an 8 ounce (237 ml) capacity constructed of polyethylene and having a 38,400 finish was provided (available from Dahl Tech Inc. of Stillwater, Minn.) along with a cooperative 38,400 polypropylene continuous thread cap available from Blackhawk Molding Company, Inc. of Addison, Ill. 60601. The bottle was filled with 120 ml of water. Sealing members were positioned within a cap and the cap tightened on the bottle with a spring torque tester available from Owens Illinois Glass Co. of Toledo, Ohio to 17 inch-pounds (196 gram-meters). The sealing member was bonded to the bottle with a Lepel high frequency induction unit Model No. T-2.5-1-KC-AP-BW. The power setting of the induction unit was varied, as expressed in each of the following Tables 1–3 as a percentage, to determine the effect on the pressure retention and removal force. After bonding, the bottle, cap and sealing member were allowed to cool and the cap was removed. For purposed of the pressure retention test, a hole 0.047 inches (1.19 mm) in diameter was drilled in each of the test samples. An Alcoa Model 490 Proper application was connected to the test samples through a gas injection pin inserted through a hole. Pressurized gas from the tester was injected into the bottle. The pressure level was recorded when a water or air leak through the seal was detected.

The tests results in Table 3 relate to test samples utilizing a 4 ounce (120 ml) 43,410 finish continuous thread bottle constructed of polyester and available from Setco, Inc. of Anaheim, Calif. and sealing members constructed according to Example 4 discussed hereinabove. The test procedures were as described above except that the bottle was filled with 110 ml of water and the cap was tightened on the bottle with 20 inch-pounds (230.5 gram-meters) of force.

The test for removal force in Tables 1 and 2 included constructing test samples as described above. After the cap is removed from the test sample, a 6 inch (15.2 cm) length of No. 898 filament tape available from Minnesota Mining and Manufacturing Company of St. Paul, Minn. was folded in half and each adhesive surface adhered to opposing major surfaces of the tab of the sealing member. The test samples were then clamped in the top portion of an Instron Model 1123 tensile tester, with the bottle inclined downwardly from the horizontal approximately 30°. The filament tape was connected to the other portion of the Instron tester. As the Instron tester pulls apart, the sealing member will separate and the level of force achieved at separation was recorded.

The same test to measure removal force was performed on bottles constructed of polyester and the results shown in Table 3, with the above procedures followed, except that the caps were tightened on the bottles with 20 inch-pounds (230.5 gram-meters) of torque.

TABLE 1

| Sealing Power | Pressure Retention (PSI) | Opening Force (oz.) |
|---|---|---|
| 47 | 12.5 | 118 |
| 49 | 15.5 | 128 |
| 51 | 19.5 | 250 |
| 53 | 25 | TAB DELAMINATED FROM MEMBRANE WITHOUT OPENING |
| 55 | 45 | TAB SEALED AND ADHERED TO MEMBRANE |

TABLE 2

| Sealing Power % Power | Pressure Retention (PSI) | Opening Force (oz.) |
|---|---|---|
| 50 | 12 | 72 |
| 52 | 16 | 155 |
| 54 | 18 | 200 |
| 56 | 16.5 | 172 |
| 58 | 18.5 | 197.5 |

TABLE 2-continued

| Sealing Power % Power | Pressure Retention (PSI) | Opening Force (oz.) |
|---|---|---|
| 60 | 16.5 | 197.5 |

TABLE 3

| Sealing Power | Pressure Retention (PSI) | Opening Force (oz.) |
|---|---|---|
| 48 | 12 | 195 |
| 50 | 14 | 200 |
| 52 | 13 | 205 |
| 54 | 19.5 | 158 |

Figure 13:
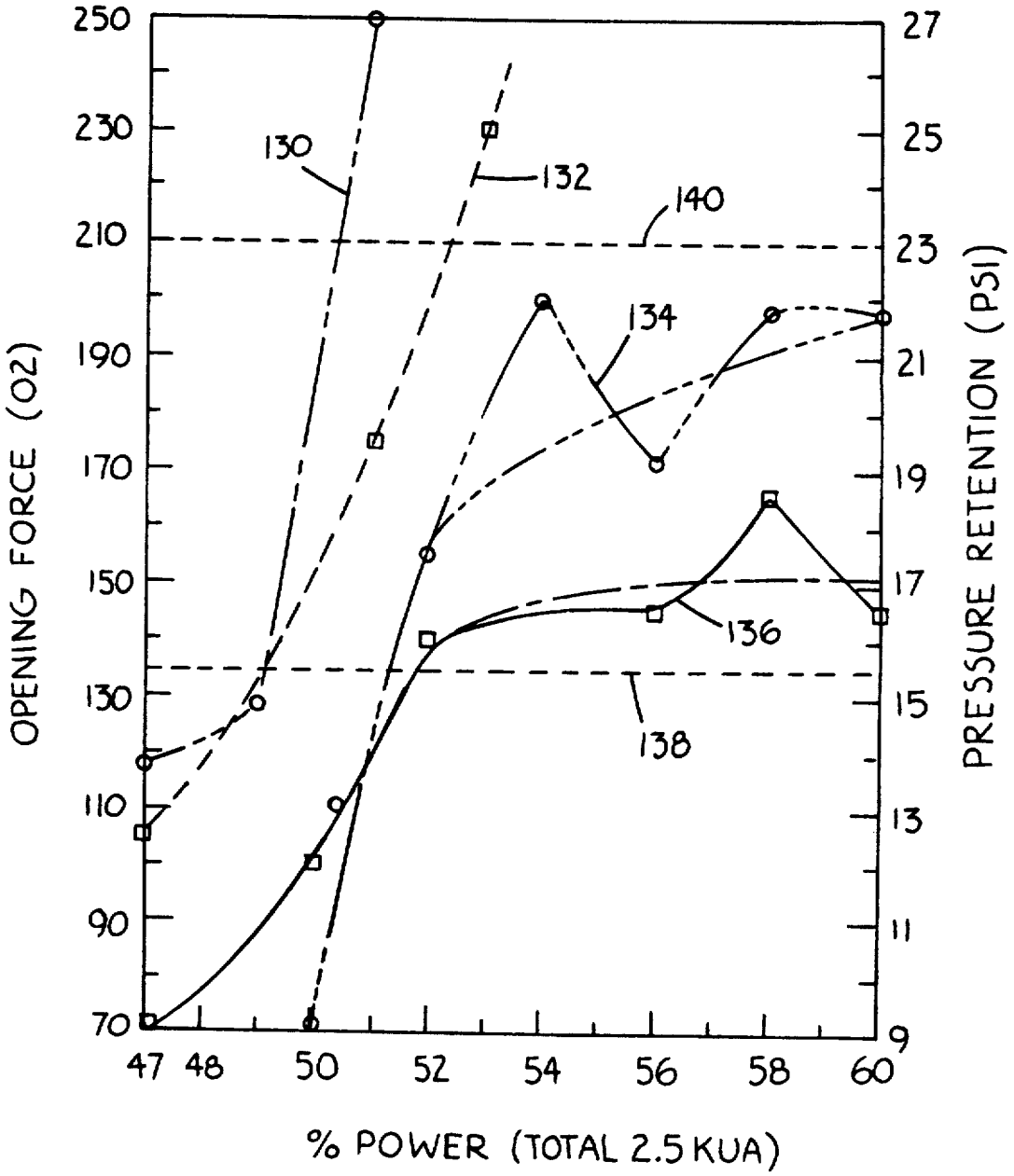
FIG. 13 is a graphical representation depicting opening force versus sealing power for the invention and a sealing arrangement which is previously known.

The results of Tables 1 and 2 are graphically represented in FIG. 13. The results of Table 1 shown as line 132 and the results of Table 2 shown as line 134. It is apparent upon an examination of the results of the tests discussed above that both of the embodiments are able to provide a sealing member that achieves an adequate, easily removable seal for a much wider range of power levels on the bonding machine than those seals previously known. However, the sealing member of Table 2 is able to maintain such a minimum pressure retention of 15.5 p.s.i. (as 138) and a removal force below 210 ounces (as at 140) over a wider range of processing conditions (i.e. from 50 to 60) than the sealing member of Table 1 (from 47 to 51). The removal force for Table 1 is shown in line 132 and the removal force for Table 2 is shown in line 136. Further, the embodiment of the invention relating to Table 2 provides a much lower removal force than the embodiment in FIG. 1 for power settings above 50%. This enables the sealing members to be manufactured more reliably and with less expense.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An improved easy opening innerseal for use with a container of the type having an opening defined by an upper rim, comprising:

a body portion having an upper surface and adapted for fitting over an upper rim of a container, said body portion including membrane means for preventing passage of fluid through said body portion; and means adapted for bonding said body portion against the upper rim of the container; said bonding means having a first bonding portion for bonding against the container rim with a first bonding force and a second bonding portion which is adhered to said first bonding portion with a second bonding force which is less than said first bonding force, said first bonding portion being fabricated of a material which has a rupture strength that is less than either of said second bonding force and said first bonding force; and means separate from said body portion and connected to said upper surface of said body portion for grasping by a user, so that said body portion may be removed from a container by pulling said upper grasping means, wherein a first part of said first bonding portion will delaminate from said second bonding portion over the container rim and remain adhered to the rim, while a second part of said first bonding portion will remain adhered to said second bonding portion, thereby exposing the opening.

2. An innerseal according to claim 1, wherein said membrane means comprises a fluid impermeable membrane.

3. An innerseal according to claim 2, wherein said membrane comprises a layer of aluminum foil.

4. An innerseal according to claim 2, wherein said membrane further comprises an adhesive layer bonded to said second bonding portion; and said first bonding portion comprises a first bonding strata and said second bonding portion comprises a second bonding strata.

5. An innerseal according to claim 4, wherein said first bonding strata has a lower melting temperature than said second bonding strata.

6. An innerseal according to claim 4, wherein said first bonding strata is comprised of a material selected from the group consisting essentially of polyester, polypropylene, polyethylene and EVA and laminates or blends thereof.

7. An innerseal according to claim 2, wherein said first bonding portion comprises a layer of heat sealable film, and said second bonding portion comprises a layer of pressure sensitive adhesive.

8. An innerseal according to claim 7, wherein said layer of heat sealable material comprises a material selected from the group consisting essentially of polyester, polypropylene, polyethylene and EVA and laminates or blends thereof.

9. An innerseal according to claim 1, wherein said grasping means comprises a tab portion, and means for transmitting an opening force from said tab portion to said upper surface.

10. An innerseal according to claim 9, wherein said tab portion and transmitting means are formed from a continuously extending force transmitting membrane.

11. An innerseal according to claim 10, wherein said force transmitting membrane is bonded to said upper surface of said body portion.

12. An innerseal according to claim 10, wherein said force transmitting membrane comprises a first layer formed from a material comprising paper.

13. An innerseal according to claim 10, wherein said force transmitting membrane comprises a first layer formed from a material comprising paper, a second layer formed from a polymeric material and an adhesive layer for bonding said first layer to said second layer.

14. An innerseal according to claim 10, wherein said force transmitting membrane comprises a layer of pressure sensitive adhesive tape having an adhesive bottom surface adhered to said upper surface at a first portion thereof; and a layer of nonadhesive material adhered to a remaining portion of said adhesive bottom surface.

15. A sealed container of the type which is provided with a safety innerseal, comprising:

a container body having an upper rim; and an innerseal comprising a body portion for fitting over said upper rim, said body portion having an upper surface and including membrane means for preventing passage of fluid through said body portion, means adapted for bonding said body portion against said upper rim, said bonding means having a first bonding portion for bonding against said container rim with a first bonding force and a second bonding portion which is adhered to said first bonding portion with a second bonding force which is less than said first bonding force, said first bonding portion being fabricated of a material which has a rupture strength that is less than either of said second bonding force and said first bonding force; and means separate from said body portion and connected to said upper surface of said body portion for grasping by a user, so that said body portion may be removed from a container by pulling said upper grasping means, whereby a first part of said first bonding portion will delaminate from said second bonding portion over the container rim and remain adhered to the rim, while a second part of said first bonding portion will remain adhered to said second sealing portion, thereby exposing the opening.

16. An innerseal according to claim 15, wherein said membrane means comprises a fluid impermeable membrane.

17. An innerseal according to claim 16, wherein said membrane comprises a layer of aluminum foil.

18. An innerseal according to claim 16, wherein said membrane further comprises an adhesive layer bonded to said second bonding portion; and said first bonding portion comprises a first bonding strata and said second bonding portion comprises a second bonding strata.

19. An innerseal according to claim 18, wherein said first bonding strata has a lower melting temperature than said second bonding strata.

20. An innerseal according to claim 18, wherein said first bonding strata is comprised of a material selected from the group consisting essentially of polyester, polypropylene, polyethylene and EVA and laminates or blends thereof.

21. An innerseal according to claim 16, wherein said first bonding portion comprises a layer of heat sealable film, and said second bonding portion comprises a layer of pressure sensitive adhesive.

22. An innerseal according to claim 21, wherein said layer of heat sealable material is comprises of a material selected from the group consisting essentially of polyester, polypropylene, polyethylene and EVA and laminates or blends thereof.

23. An innerseal according to claim 15, wherein said grasping means comprises a tab portion, and means for transmitting an opening force from said tab portion to said upper surface.

24. An innerseal according to claim 23, wherein said tab portion and transmitting means are formed from a continuously extending force transmitting membrane.

25. An innerseal according to claim 24, wherein said force transmitting membrane is bonded to said upper surface of said body portion.

26. An innerseal according to claim 24, wherein said first transmitting membrane comprises a first layer formed from a material comprising paper.

27. An innerseal according to claim 24, wherein said force transmitting membrane comprises a first layer formed from a material comprising paper, a second layer formed from a polymeric material and an adhesive layer for bonding said first layer to said second layer.

28. An innerseal according to claim 24, wherein said force transmitting membrane comprises a layer of pressure sensitive adhesive tape having an adhesive bottom surface adhered to said upper surface at a first portion thereof; and a layer of non-adhesive material adhered to a remaining portion of said adhesive bottom surface.

* * * * *

UNITED STATES PATENT AND TRADEMARK OFFICE

CERTIFICATE OF CORRECTION

PATENT NO. : 5,004,111

DATED : April 2, 1991

INVENTOR(S) : McCarthy

It is certified that error appears in the above-identified patent and that said Letters Patent is hereby corrected as shown below:

Col. 4, line 12, delete "." after the word "mg".
Col. 4, line 36, insert --.-- after the word "(0.18mm)".
Col. 4, line 59, insert --, which-- after the word "adhesive".
Col. 4, line 63, "0.05" should read --.05--.
Col. 5, line 33, "Kauakuna" should read --Kaukauna--.
Col. 5, line 48, "Kauakuna" should read --Kaukauna--.
Col. 9, line 19, "than" should read --that--.
In the claims:
Claim 1, col. 13, line 2, "wherein" should read --whereby--.
Claim 22, col. 14, line 40, "comprises" should read --comprised--.

Signed and Sealed this

Second Day of November, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,004,111

DATED : April 2, 1991

INVENTOR(S) : Theresa A. McCathy

It is certified that error appears in the above-indentified patent and that said Letters Patent is hereby corrected as shown below:

Claim 16, col. 14, line 18, delete "An innserseal" and insert --A sealed container--.

Claim 17, col. 14, line 21, delete "An innserseal" and insert --A sealed container--.

Claim 18, col. 14, line 23, delete "An innserseal" and insert --A sealed container--.

Claim 19, col. 14, line 28, delete "An innserseal" and insert --A sealed container--.

Claim 20, col. 14, line 31, delete "An innserseal" and insert --A sealed container--.

Claim 21, col. 14, line 36, delete "An innserseal" and insert --A sealed container--.

Claim 22, col. 14, line 40, delete "An innserseal" and insert --A sealed container--.

UNITED STATES PATENT AND TRADEMARK OFFICE

CERTIFICATE OF CORRECTION

PATENT NO. : 5,004,111

DATED : April 2, 1991

INVENTOR(S) : Theresa A. McCathy

It is certified that error appears in the above-indentified patent and that said Letters Patent is hereby corrected as shown below:

Claim 23, col. 14, line 45, delete "An innserseal" and insert --A sealed container--.

Claim 24, col. 14, line 49, delete "An innserseal" and insert --A sealed container--.

Claim 25, col. 14, line 52, delete "An innserseal" and insert --A sealed container--.

Claim 26, col. 14, line 55, delete "An innserseal" and insert --A sealed container--.

Claim 27, col. 14, line 58, delete "An innserseal" and insert --A sealed container--.

Claim 28, col. 14, line 63, delete "An innserseal" and insert --A sealed container--.

Signed and Sealed this

Fifth Day of March, 1996

*Attest:*

Bruce Lehman

BRUCE LEHMAN

*Attesting Officer*

*Commissioner of Patents and Trademarks*